US006871439B1

(12) United States Patent
Edwards

(10) Patent No.: US 6,871,439 B1
(45) Date of Patent: Mar. 29, 2005

(54) TARGET-ACTUATED WEAPON

(75) Inventor: Oliver Jackson Edwards, Foster City, CA (US)

(73) Assignee: Zyberwear, Inc., Ocoee, FL (US)

( * ) Notice: Subject to any disclaimer, the term of this patent is extended or adjusted under 35 U.S.C. 154(b) by 0 days.

(21) Appl. No.: 10/663,459

(22) Filed: Sep. 16, 2003

(51) Int. Cl.[7] ..... F41A 17/00
(52) U.S. Cl. ..... 42/84; 89/41.01; 89/41.17
(58) Field of Search ..... 42/84; 89/41.01, 89/41.17

(56) References Cited

U.S. PATENT DOCUMENTS

| | | | | |
|---|---|---|---|---|
| 3,650,174 A | | 3/1972 | Nelson | 89/28 |
| 4,063,368 A | * | 12/1977 | McFarland et al. | 434/22 |
| 4,285,153 A | | 8/1981 | Crouch | 42/84 |
| 4,332,098 A | | 6/1982 | Estenevy | 42/84 |
| 4,370,914 A | * | 2/1983 | Voles | 89/41.05 |
| 4,402,251 A | * | 9/1983 | Burke et al. | 89/41.03 |
| 4,606,256 A | * | 8/1986 | De'Ath | 89/41.09 |
| 4,718,187 A | | 1/1988 | Blake | 42/84 |
| 4,793,085 A | | 12/1988 | Surawski | 89/36 |
| 5,272,828 A | | 12/1993 | Petrick et al. | 42/84 |
| 5,392,688 A | | 2/1995 | Boutet et al. | 89/41.09 |
| 5,544,439 A | | 8/1996 | Grember et al. | 42/114 |
| 5,625,972 A | | 5/1997 | King et al. | 42/84 |
| 5,937,558 A | | 8/1999 | Gerard | 42/84 |
| 5,966,859 A | | 10/1999 | Samuels | 600/500 |
| 6,123,007 A | | 9/2000 | O'Dwyer | 89/135 |
| 6,174,288 B1 | | 1/2001 | Samuels | 42/70.11 |
| 6,237,462 B1 | * | 5/2001 | Hawkes et al. | 89/41.05 |
| 6,286,241 B1 | | 9/2001 | Constant et al. | 42/84 |
| 6,321,478 B1 | | 11/2001 | Klebes | 42/84 |
| 6,360,469 B1 | | 3/2002 | Mikuta et al. | 89/41.05 |
| 6,510,643 B2 | | 1/2003 | O'Dwyer | 42/84 |
| 6,572,375 B2 | * | 6/2003 | Shechter et al. | 434/19 |

* cited by examiner

*Primary Examiner*—Michael J. Carone
*Assistant Examiner*—M. Thomson
(74) *Attorney, Agent, or Firm*—Brian S. Steinberger; Law Offices of Brian S. Steinberger, P.A.

(57) ABSTRACT

A weapon for accurately launching a projectile of a firearm toward a target and no other point of strike, comprising an electrically-actuated firearm with axially-stacked ammunition loads, a target sensor unit which generates a target sensor signal at such times as the projected bullet's point of strike and the projected target position coincide; a fire controller which generates a firing signal when both a trigger signal and a target sensor signal are present; and a sequence controller actuated by the firing signal to ignite one or more of the axially stacked ammunition loads to cause the projectile to strike the projected location of a target.

15 Claims, 5 Drawing Sheets

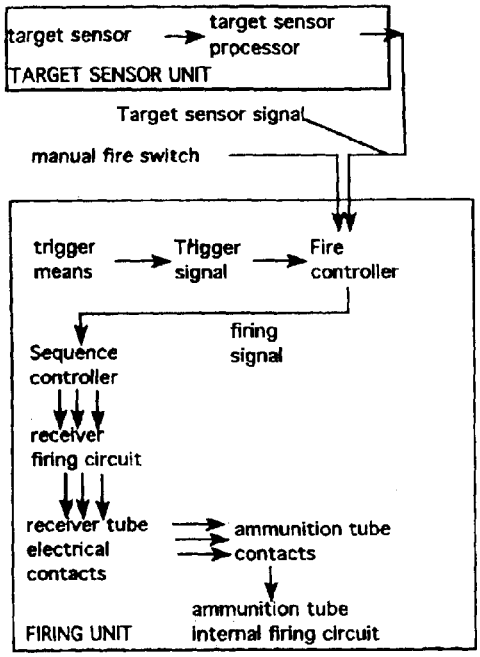
FIG.1
FIG.3
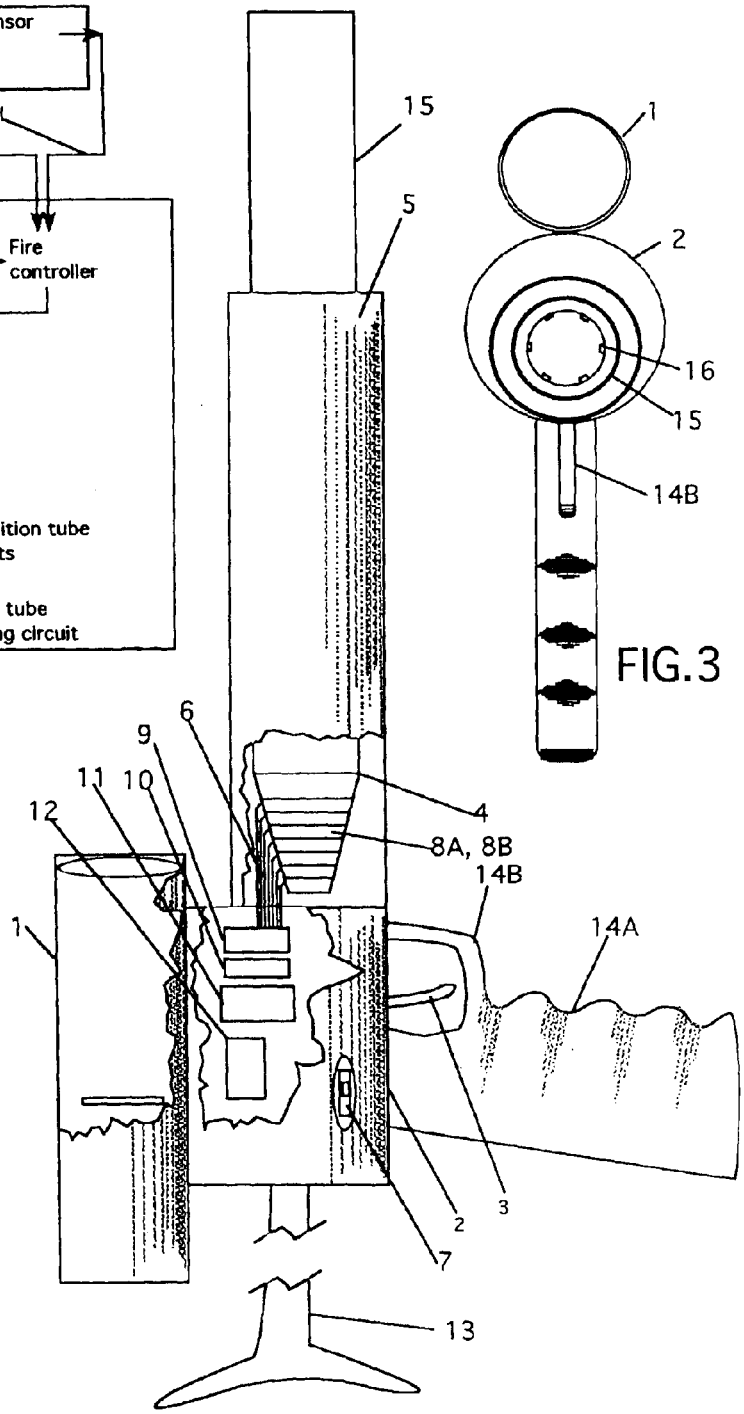
FIG.2

FIG.7
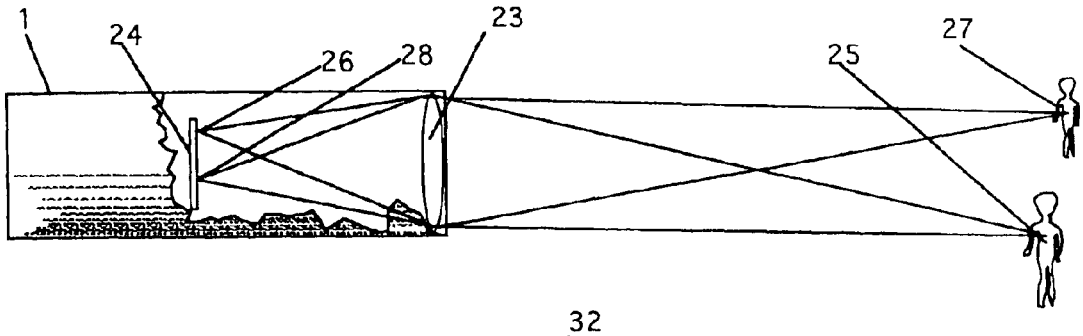
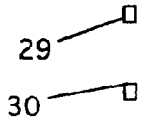
FIG.8
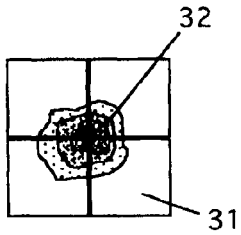
FIG.9
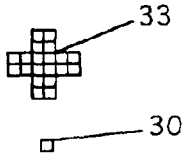
FIG.10
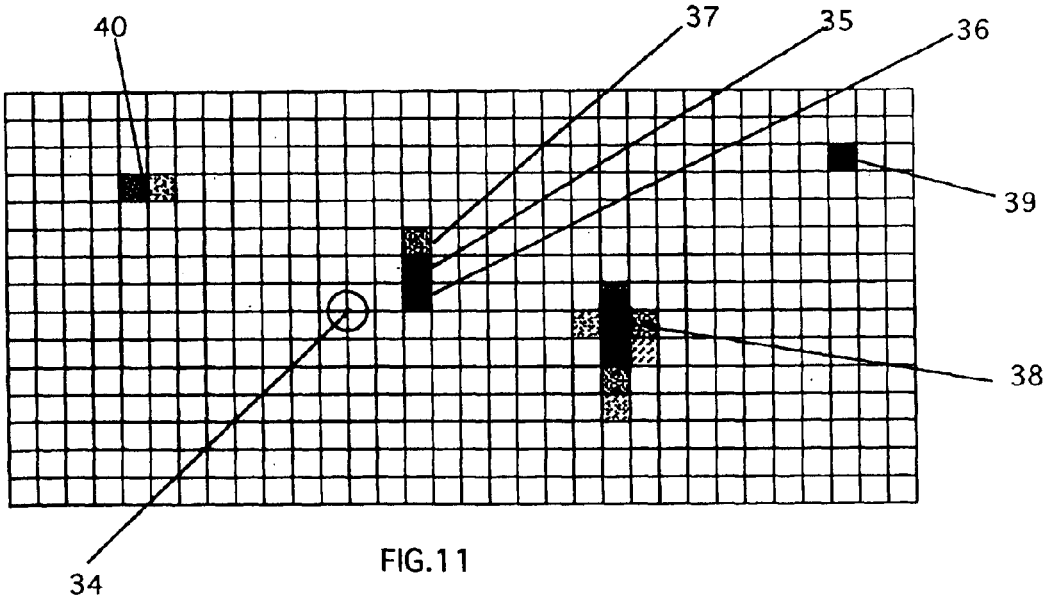
FIG.11

TARGET-ACTUATED WEAPON

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates to weapons and more particularly to a novel weapon selectively capable of firing only on targets having a particular radiative characteristic.

2. Description of the Background Art

In the past, it has been the conventional practice to employ a weapon having various aids to sighting the weapon: i.e., indicating to the operator the point of strike of the missile upon a visualized background or field of view. The effective use of such weapons has involved having the operator visually acquire a target image (whether by direct vision or by augmented vision such as image intensifier, video or thermal infrared telescope), aim the weapon by bringing the weapon sight ("crosshairs") onto the target image, and choose the moment to manually pull a trigger to cause the weapon to discharge the missile.

The literature is rich in inventions to enhance respectively the sighting means, the manual trigger means, the ammunition, ammunition delivery mechanization, and the operator's optical/mechanical/electronic interface. It is very nearly empty of art addressing the problem of reliably firing the weapon on, and only on the target. Historically, the use of firearms to cause enemy casualties has been marginally effective. Some 5,000 rounds were fired in the American Civil War for each enemy casualty. Such ammunition expenditure rose in WWII to 35,000 rounds. American forces in Viet Nam are variously estimated to have expended 100,000 to 200,000 small-arms rounds, or some two to four tons of small-arms ammunition, per enemy casualty.

This problem of hitting the target is not primarily a challenge of firearm design. On a rifle range the soldier is trained for endless hours to compensate for mechanical and ballistic limitations of his weapon and to repeatedly put his bullets "in the black" of the small paper targets. The primary problem with firearm ineffectiveness in the field is the human involvement. This includes the time to notice and identify an uncertain and moving target, the time to bring the weapon into alignment, the erratic motion of the shooter at the best of times, his increased oscillation and shaking during combat, and the movement of the weapon as the trigger is jerked, and again as the firing pin plunges into the primer. When the target is running, hiding and shooting back, the soldier tends simply to fire as many bullets as he can as fast as he can in the general direction of the enemy, in hopes that some of them will hit something useful. Prior art firearms thus have the immediate safety disadvantage that almost no shot fired in combat causes an enemy casualty. Statistically, weapon fire in combat serves only to intimidate the enemy or to comfort the shooter. Further, bringing the ammunition to its point of use is a great logistics and soldier burden. In addition, the monetary cost of such combat expendables is large: of the order of the cost of a personnel vehicle.

What has been lacking in prior art is a weapon which can sense when a target is present at the projected point of impact of the missile, and precisely fire the weapon at that instant. This requires that a target sensor be provided with a firearm means which is capable of electric initiation, which discharges quickly in response to the electrical signal, and which provides repeating cycling without the delay and complexity of mechanical reloading. To be of practical value in combat, the sensor electronics must provide corrections for both target and weapon motion. The firearm must be free of mechanical vibrations or shaking which would disturb the quality of aim, and the entire system must be easily manufactured, low in cost, and rugged in field use.

A practical target sensor and method for integration with such a weapon has not been available. U.S. Pat. No. 5,392,688 (1995) shows the use of a television camera as a weapon sight for aiming, wherein the rifleman designates the "target" by placing the scope crosshairs on it and partially depressing the trigger. While it is not clear why the rifleman would at that point prefer simply to kill the target, this patent invokes an undisclosed "autolock-follow processor" circuit to differentiate and follow a target and ignore the background. Such capability is not generally known in the art. Further, the weapon is described simply as "fired electrically" and no useful firearm method is taught.

U.S. Pat. No. 4,370,914 (1983) teaches a gun-aiming method for calculationally averaging the swings of a rifleman's point of aim by gyroscopic measurement. The rifleman first designates the desired point of aim using his trigger switch. As said above, it is unclear why shooting at that point would not be preferable to later swinging back to that point and electrically firing the weapon. Of further disadvantage, the sighting method is taught by its claimed results, not as an limitable design or manufacture. Further, the use of a visible-light camera is taught and illustrated and claimed, which greatly limits the use of the method in combat. Further, no method for electrically firing the weapon is taught, but the electrical firing is simply invoked without teaching. Finally, no provision is taught for correcting for the effects of angular velocity either of the target or of the weapon; thus at best the taught method of aiming would be accurate only for a stationary weapon and stationary target.

Several methods in the art are intended to relate the weapon fire to the sensed presence of a target. U.S. Pat. No. 5,544,439 (1996) describes a modification to a prior art weapon with percussive firing, wherein the sear is operated by a solenoid in response to a target signal. The target signal is generated by a single infrared detector at the focal plane of a lens. In that only a single detector is used, the weapon can provide no compensation for either target motion or weapon motion. Additionally, no method of interpreting the signal to differentiate human radiation from other radiation patterns is taught. Use of electromechanical actuation has the disadvantages both of firing pin jolt and solenoidal mass acceleration. Both of these are likely to cause a significant movement of the point of aim between electronic "fire" command and the exit of the bullet from the barrel.

U.S. Pat. No. 5,966,859 (1999) describes the use of infrared radiation from a target imaged on a pyroelectric quad cell through unspecified optical filters, to cause a solenoid to pull the trigger on a gun. Pyroelectric detectors require the use of a mechanical chopper to modulate the incident optical beam on and off, with the inherent disadvantages of mechanical complexity, fragility and loss of half the target signal time. Further, use of a pyroelectric quad cell significantly limits the detection range due to its electronic noise. Additionally, no method is taught for interpreting the signal to differentiate human radiation from, e.g., flames. No provision is made for compensating the point of aim for target motion or weapon motion. The invention cannot deal with separate or overlapping targets, but would shoot exactly between two targets standing near each one another. The aiming disadvantages of mechanical percussion firing are further increased by the taught impulse motion and delay in action of a solenoid.

U.S. Pat. No. 6,174,288 (2001) couples the matter of U.S. Pat. No. 5,966,859 above with a heart-beat cycle aiming indicating device, with no abatement of the disadvantages noted above.

In the rich literature of inventions related to weapons, almost all firearms taught since 1900 describe or assume ammunition loads to be cartridges pre-packaged with ammunition and primer, loaded one at a time into the weapon receiver, and mechanically discharged by percussion on the primer. After firing, the chamber is cleared and a new ammunition load is introduced for firing. This procedure can be done in a single shot or manual manner or, as in automatic weapons, the pace or loading and unloading procedure cycled faster so that multiple rounds or shots can be fired in quick succession. However, it is to be understood that regardless of how fast the mechanism for loading and unloading may be driven by either recoil or external power, the sequence taught is first to load the firing chamber with the proper cartridge followed by firing of that cartridge and removal of the residue or cartridge casing which is then replaced by another cartridge or ammunition load preparatory to a second firing. Further, the method for igniting the propelling charge is typically mechanical: the fall of the firing pin on the primer. The use of percussion primers and associated physical components in modern firearms has imposed constraints which have inhibited significant advances in accuracy, safety, performance and reliability.

Although electronic components have been designed into the ignition systems of firearms, generally the electrical components either supplement or displace existing parts of the mechanical firing mechanism. A number of methods for discharging a weapon using an electrical signal have been taught in the art. These fall generally into one of two classes: electro-percussive firing of conventional primers, or electric ignition of flammable primers. Electro-percussive inventions are exemplified by the following.

U.S. Pat. No. 4,718,187 (1988) and U.S. Pat. No. 4,793,085 (1988) teach the use of a solenoid to actuate the firing pin, which increases the vibration problems of mechanical pulse.

U.S. Pat. No. 6,360,469 (2002) and U.S. Pat. No. 5,937,558 (1999) teach the use of a high voltage pulse through a mechanically driven firing pin to ignite the primer, which retains the vibration while adding a thermal pulse rise-time delay.

U.S. Pat. No. 4,285,153 (1981) describe a form of axially preloaded magazine in which the ammunition loads are sequentially fired through a plastic tube, inserted as a unit behind a separate smooth-bore weapon barrel. This disadvantageous separation of the ammunition from the barrel is overcome in U.S. Pat. No. 6,123,007 (2000) and U.S. Pat. No. 6,510,643 (2003), in which preloading of the actual barrel is taught. However, these last teach only a particular method of barrel assembly, and do not address the system issues of such an electrically actuated firearm, especially a means to direct the fire to the target.

Some electrical firearms using non-impact electric ignition of the primer have been developed, but with significant limitations. For examples, U.S. Pat. No. 4,332,098 (1982), U.S. Pat. No. 6,286,241 (2001) and U.S. Pat. No. 3,650,174 (1972) teach the use of a spring-loaded pin delivering a high voltage pulse to resistively heat and ignite the primer, which requires a relatively slow firing cycle. U.S. Pat. No. 5,625,972 (1997) discloses an electrically discharged firearm in which a heat sensitive primer is ignited by a voltage induced across a fuse wire extending through the primer. A laser ignited primer is disclosed in U.S. Pat. No. 5,272,828 (1993), wherein an optically transparent plug or window is centered in the case of the cartridge to permit laser ignition of the primer. In such a device, however, power requirements are substantial and limiting. In none of the devices of this paragraph is any other method of sustained fire feasible, except by mechanically rejecting spent cartridges and cycling another into the breech block, with the disadvantages of mechanical disturbance of the point of aim and slow cycle rate as already said.

Difficulties and problems have been encountered when employing such prior art devices and procedures which stem largely from the fact that the ammunition is loaded sequentially into the chamber which is time consuming and the firing is achieved through mechanical means which is slow in reaction time. Thus the prior art does not lend to nonmechanical rapid firing of ammunition loads nor lend to fast-response electronic control of the discharge. Additionally, the "fire" decision is not based on corrected prediction of the intersection of the point of impact on a human-spectrum radiator, including target motion and weapon motion.

In addition to the lack of a target sensor which is capable of sensing a target, differentiating it from the background, separating and locating intersecting target images, and compensating for weapon and target motion, and the lack of a fast-firing, non-mechanical, easily manufactured firearm component, provision of integration of such a target sensor with such a weapon has been lacking.

Therefore, a long standing need has existed to provide a novel weapon which fires only when the bullet or missile will usefully impact in a target. Further, a long standing need has existed to provide a target sensor combined with a corresponding novel weapon which weapon incorporates a plurality of ammunition loads which may be electronically detonated so as to fire individual or multiple loads from within the same firing chamber, and thus be amenable to near-instantaneous firing response to electrical signals from the target sensor, without mechanical impulse or vibration.

BACKGROUND OF THE INVENTION—OBJECTS AND ADVANTAGES

Accordingly, besides the objects and advantages of the target-actuated weapon described above, several objects and advantages of the present invention are:

(a) to provide a firearm having multi-function capabilities attributable to an all-electric fire control system that actuates the discharge only when the firearm is aimed to strike a target.

(b) to provide a target-actuated firearm with rapid firing of missiles in predetermined sequence, only upon targets as available.

(c) to provide a target-actuated firearm with selectable manual control of firing of missiles in predetermined sequence independent of target availability.

(d) to provide a firearm having great savings of ammunition, which if otherwise fired would miss the target.

(e) to provide a firearm having increased lethal effectiveness for the enhanced protection of a user in battle.

(f) to provide a firing and ignition system capable of transmitting a firing signal from a target sensor processor through sequencing circuitry connected to a power source and causing firing pulses to sequentially launch axially-stacked missiles.

(g) to provide a firearm having greater fire power than can otherwise be obtained by prior automatic weapons, by utilization of axially-stacked loads of ammunition and provision of electrical signals for firing them sequentially at an electronically-controlled rate.

(h) to provide a firearm which does not require selective aiming to rapidly place at least one missile onto each target over which the point of aim passes as it is traversed.

(i) to provide a safe, reliable, high-performance, modular, target-actuated firearm that uses electrical power to ignite a primer for firing.

(j) to provide a firearm that eliminates the need for costly, moving and wear-prone mechanical components for igniting ammunition primer.

(k) to provide a firearm that eliminates the need for cumbersome, jarring and wear-prone mechanical components to sequentially load cartridges into a breech block.

(l) to provide a target-actuated firearm having enhanced reliability, efficient use of munitions, simplified manufacturability, and competitive cost, inherently attributable to its modular design.

(m) to provide a firearm having superior target sensing according to selected target characteristics.

(n) to provide a firearm having compensation of firing direction for target motion and for weapon motion.

(o) to provide superior performance by eliminating mechanical components associated with conventional firing mechanisms which tend to pull or jar a weapon's aim off target.

Therefore, it is among the primary objects of the present invention to provide a novel weapon which incorporates a target sensor and a plurality of ammunition loads that may be fired in a serial manner and in accordance with a pre-determined sequence from a single barrel, on the occasion of having both a firing command and a target at the missile's point of impact.

The present invention attains these objects and other inherent objects and advantages as described herein.

SUMMARY

In accordance with the present invention a weapon comprises an electrically-actuated firearm, a target sensor, analytic and power electronics to actuate the weapon fire at such time both that the user has signaled a desire or readiness to fire and that a target is present at the expected point of strike of the missile.

Accordingly, the problems and difficulties already described are obviated by the present invention which provide a novel weapon having a target sensor unit comprising a target sensor and a target sensor processor, which transmits a "target-present" target sensor signal to a fire controller at such times that the point of missile impact coincides with a projected target position. The fire controller creates a firing signal when it receives both a "target present" signal and a trigger signal. A stock is provided for mounting one or a plurality of ammunition tubes and for incorporating a trigger mechanism. A sequence controller means actuates a firing circuit means upon receipt of the firing signal. An ammunition tube is provided which houses a plurality of axially stacked ammunition loads wherein each load comprises a detonator, gunpowder, wadding and suitable missile. The ammunition tube incorporates a firing circuit means, which may be electronically energized via the sequence controller for selectively detonating selected or respective ones of the plurality of ammunition loads.

The target sensor has an electronic fiducial mark which is adjusted to coincide with the conjugate image of the missile's expected point of impact. The target sensor receives radiation from the target, and provides an image signal to the target sensor processor. Typically, this will be infrared radiation, and the preferred radiation for human targets will be detected in the waveband 6 to 20 microns, and preferably in the waveband of 8 to 14 microns. The target sensor processor discriminates the target radiation from the background radiation and determines the velocity of the target relative to the average background, and transmits a "target present" signal to the firing unit when the projected target position is coincident with the fiducial. The firing unit transmits a firing signal when both a trigger signal and a target present signal are received. This firing signal causes the receiver firing circuit means to initiate a firing pulse which is received by the ammunition tube firing circuit means, and thereby ignites the gunpowder in the selected ammunition load to place the missile approximately on the centroid of the target. An electronic sequence controller is operably connected between the trigger mechanism and the receiver firing circuit so that the sequence of firing of the ammunition loads for units is sensibly automatic and does not require any pre-selection on the part of the operator. Means are provided within the bore of the ammunition tube for defining individual firing chambers therein and for accepting and distributing the forces of recoil into the barrel to prevent pre-ignition of the next propellant charge, and into the stock of the weapon for external support.

A manual fire selector switch means is provided, whereby the fire controller may be actuated and the weapon fired independent of any target sensor signal.

BRIEF DESCRIPTION OF THE DRAWINGS

In the drawings, repeated elements retain the same number.

FIG. 1 shows a flow chart of the firing algorithm of the present invention;

FIG. 2 shows a side-elevational view, partly in section, of a novel firearm or weapon incorporating the present invention;

FIG. 3 shows a front-elevational view of the firearm or weapon shown in FIG. 2;

FIG. 7 shows a side-elevational view of a target sensor employed in the weapon of FIGS. 2 and 3 and partly broken away to expose the lens means and the detector, and showing the ray traces from typical targets;

FIG. 8 shows a simplest detector element array;

FIG. 9 shows a quad-cell detector array, with an indicated target image;

FIG. 10 shows a cruciform detector array;

FIG. 11 shows a matrix detector array, with a multiplicity of typical target images;

Figure 4:
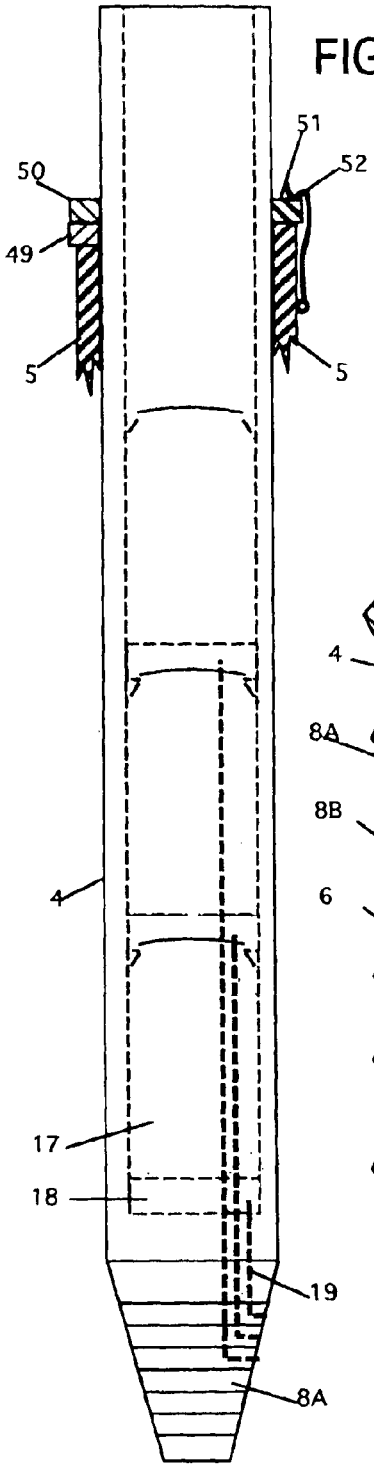
FIG. 4 shows a side-elevational view of a three-chambered ammunition tube employed in the weapon, of FIGS. 2 and 3, including its interface with the muzzle end of the receiver, with tube bore and typical internal ammunition loading indicated in dotted lines.

| DRAWINGS - REFERENCE NUMERALS | |
|---|---|
| 1 | Target Sensor |
| 2 | Stock |
| 3 | Trigger |
| 4 | Ammunition tube |
| 5 | Ammunition tube receiver |
| 6 | Receiver firing circuit |
| 7 | Manual fire selector |
| 8A | Ammunition tube contacts |
| 8B | Receiver tube contacts |
| 9 | Fire controller |
| 10 | Sequence controller |
| 11 | Target sensor processor |
| 12 | Power supply |
| 13 | Shoulder interface |
| 14A | Hand grip |
| 14B | Trigger guard |
| 15 | Barrel |
| 16 | Lands |
| 17 | Missile assembly |
| 18 | Propellant |
| 18A | Propellant, solid missile |
| 18B | propellant, bursting missile |
| 19 | Ammunition tube firing circuit |
| 20A | Wadding, solid missile |
| 20B | Wadding, bursting missile |
| 21A | Solid missile |
| 21B | Bursting missile |
| 22A | Detonation plate, solid missile |
| 22B | Detonation plate, bursting missile |
| 23 | Lens means |
| 24 | Sensing reticle |
| 25 | First target |
| 26 | Image of first target |
| 27 | Second target |
| 28 | Image of second target |
| 29 | single-sensor reticle |
| 30 | reference sensor |
| 31 | Quad cell element |
| 32 | Image on quad cell |
| 33 | Cruciform reticle |
| 34 | Image of point of strike |
| 35 | Bright target spot |
| 36 | Dimmer target spot |

-continued

| DRAWINGS - REFERENCE NUMERALS | |
|---|---|
| 37 | Yet dimmer target spot |
| 38 | target image |
| 39 | distant target image |
| 40 | Target image of intermediate distance |
| 41 | Vertical median irradiance |
| 42 | horizontal median irradiance |
| 43 | Single blob extended image |
| 44 | Multiple blob extended image |
| 45 | Second sensing reticle |
| 46 | Beamsplitter |
| 47 | Image focal cone |
| 48 | Lens means |
| 49 | First window |
| 50A | Boresight; point of aim |
| 50B | Point of aim offset angle |
| 51A | A first target |
| 51B | Target offset angle |
| 52 | A second target |
| 53 | First window |
| 54 | Second window |

DETAILED DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

The weapon will be described in two parts: the electrically controlled firing subsystem and the target sensor subsystem which controls the firing subsystem. Referring to FIG. 1, the operation of the novel weapon of the present invention is illustrated in an operational flow diagram. The electrically controlled firing system has two major subsystems: the target sensor unit and the firing unit. Starting from the top, the system has a power-saving on/off switch, not shown. A target sensor creates a signal related to the scene which it images, and the signal is analyzed in the target sensor processor. The target sensor processor outputs a signal when a target is detected and projected to be at the weapon's projected point of impact. In the firing unit, a trigger means creates a "fire" trigger signal which indicates the desire of the operator to have the weapon fire. Signals from the trigger means and the target sensor processor are input to a fire controller which performs a logical AND operation, and from which \a signal is sent to the sequence control means. The sequence control means energizes one of a plurality of conductors in the receiver firing circuit in the weapon stock, which signal is conductively transmitted to one of a matching plurality of conductors comprising the ammunition tube firing circuit in the proximal end of ammunition tube. Each of the conductor pairs operates through the ammunition tube internal firing circuit to cause the discharge of a single ammunition load. if the operator actuates the trigger means AND if the target sensor processor indicates that a target is present at the point of impact, then the weapon fires one or more ammunition loads, in sequential order from the muzzle end to the receiver end of the ammunition tube. Additionally, an override means is provided as a "manual fire switch" which on closure enables the operator to discharge the weapon directly, at will, independent of signals from the sensor.

Referring to FIG. 2, the novel weapon of the present invention is illustrated in a side view which includes a target sensor 1, and a stock 2 having a recoil transfer means 13 extending from one end thereof. The stock 2 also includes a trigger means 3 and a hollow ammunition tube receiver 5 which can insertably accept and fixedly locate one or more ammunition tubes 4. As exemplified in this preferred embodiment, the stock 2 has a hand grip 14A and trigger guard 14B. In the preferred embodiment the recoil transfer means 13 is a shoulder interface. In a pistol embodiment of the weapon this will not be included; the hand grip 14B will serve to absorb the recoil. In a mortar or field piece embodiment of the weapon the recoil means may be a mounting structure which transfers the recoil to the surface which supports the mounting structure The ammunition tube 4 contains a plurality of contiguous axially stacked ammunition loads adjacent the receiver 5 and is terminated at the distal end with a barrel 15 which serves to direct the trajectory of the missile. The ammunition loads are individually discharged by electrical signals from the sequence controller 9, which signals are transmitted to the ammunition load via the receiver firing circuit 6, the receiver tube electrical contacts 8B, the ammunition tube contacts 8A (here 8A and 8B are shown superimposed) and the ammunition tube internal firing circuit which is shown in a subsequent figure. The trigger means 3 creates an electrical signal to the fire controller 10. The target sensor 1 creates a signal to the target sensor processor 11 which analyzes the input signal to note the presence of a target, and transmits a "target present" signal to the fire controller 10. The fire controller 10 typically will be a microprocessor means, and performs a mathematical AND operation on the inputs from the trigger means 3 and the target sensor processor 11 to create an output signal pulse to the sequence controller 9. On receipt of the latter signal, the sequence controller 9 discharges the ammunition loads sequentially, from the muzzle end to the receiver end. These electrical operations are powered by a power supply 12, typically carried within the stock 2.

A manual fire selector 7 is a switch means which enables direct operation of the fire controller 10, such that the weapon is caused to discharge in a preset firing sequence independent of the signal state from the target sensor 1. The preset firing sequence might be a single shot, or a plurality of sequential shots. The preset firing sequence is stored in the fire controller 10, and is entered by the operator using a prior art data entry pad such as a key pad, which is not shown.

For exposition, the firing signal generator, sequence controller, target sensor processor and power supply are shown as separate elements. Obviously these may be combined in one or more electronics units for manufacturing convenience.

The weapon of FIG. 2 is shown as having a single ammunition tube 4. In another embodiment, the receiver 5 will have a plurality of parallel ports which can insertably accept and fixedly locate a corresponding plurality of ammunition tubes 4. This multiplies the number of missiles which may be fired without replacing ammunition tubes. Further, this multiple-tube embodiment permits multiple types of ammunition loads to be installed for selected use, such separate ammunition tubes each containing for examples shotgun loads, or grenade loads, or solid shot loads. In this latter embodiment comprising a plurality of ammunition tubes in the receiver, the fire selector 7 will further provide for selection of the order in which the ammunition tubes are to be discharged.

Referring to FIG. 3, the novel weapon of the present invention is illustrated in an end view of the muzzle end which further illustrates the target sensor 1, the receiver 5, and the barrel 15 where the lands 16 are shown. The lands are raised spirals in the barrel which serve to rotate solid projectiles to gyroscopically stabilize their axes in flight.

Referring to FIG. 4, the ammunition tube 4 is shown in an external view, with internal parts indicated in dotted lines. The ammunition loads comprise propellant 18 and the missile assembly 17. The ammunition tube firing circuit 19 is comprised of a plurality of conductors, each of which leads from a segment on the ammunition tube contacts 8A to the respective propellant load 18. The ammunition tube firing circuit carries the electrical signal which ignites the propellant; the other side of the circuit, or "ground" is to the casing of the ammunition tube, which is further connected to one of the segments of the ammunition tube contacts 8A. In this preferred embodiment the electrical contacts 8A are individual circular rings stacked within a conical shape envelope, and insert into a congruent mating conical port in the ammunition tube receiver 5, which also serves to mechanically locate the receiver end of the ammunition tube 4 relative to the stock 2. The circular symmetry of the electrical contact rings permits insertion and functioning of the ammunition tube in any rotational position. The ammunition tube 4 is axially compressed into the ammunition tube receiver 5 by a captivation means linking the two elements comprising a ring 49 on the ammunition tube and a clamping means 50 or 51 affixed to the receiver.

In this preferred embodiment, the ring 51 affixed to the ammunition tube is clamped against a mating surface integral to the receiver 5, and is axially fastened thereto by a mechanical clamp means 52. In another embodiment the ring 50 is of a ferromagnetic material and a mating ring 49 integral to the receiver 5 provides the axial clamping force, where either or both rings 49 and of a re of magnetized material.

The ammunition tube can be preloaded at the factory or by the user in the field, serving as a magazine of ammunition loads. In the field this loaded ammunition tube can be quickly installed into the ammunition tube receiver 5 as a preloaded magazine. This permits the user to rapidly eject an empty ammunition tube and fully reload the weapon in a few seconds with one or a plurality of fully-loaded ammunition tubes. Uniquely, the expendable ammunition tubes which also serve as a barrel for directing the missile are thus quickly replaceable. This has the further great advantage that much thinner barrels of lighter weight materials can be used for the weapon, as contrasted with the prior-art use of heavy steel barrels capable of shooting thousands of rounds with acceptable erosion. This can enable a savings in weapon weight of 2 to 5 pounds, fully loaded. It has the further great advantage that the weapon of the invention can be fired in burst rates of tens of thousands of rounds per minute; in that greatly accelerated barrel erosion attendant on such extraordinary fire rates is acceptable since the barrel is always or often new.

Figure 5:
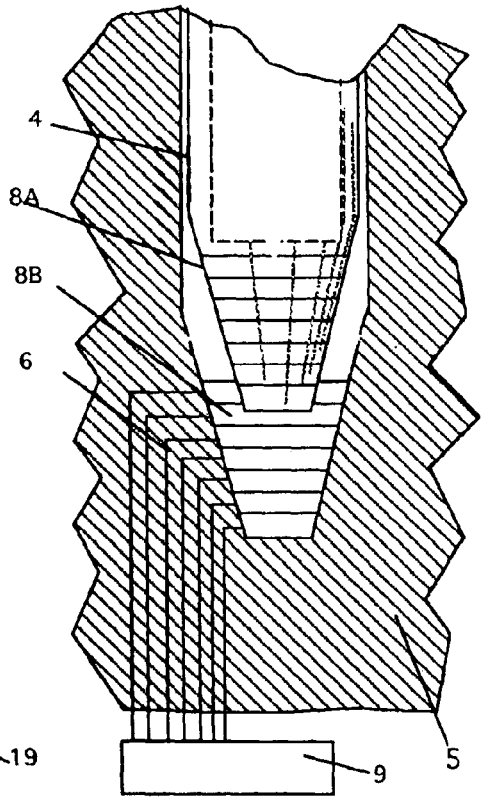
FIG. 5 shows a fragmentary sectional view of the ammunition tube receiver showing circular electrical conductors on the ammunition tube and congruent electrical conductors in the ammunition tube receiver.

Referring now to FIG. 5, the ammunition tube receiver 5 is shown in cross section. The ammunition tube receiver 5 and the ammunition tube 4 have a conical congruent interface for relative mechanical location in three dimensions, and to thus position the receiver tube contacts 8B of the conductors of the receiver firing circuit 6 so that in operation they electrically contact ammunition tube contacts 8A, respectively. In this preferred embodiment, the conductors of the receiver firing, circuit 6 are terminated in conical electrodes SA integral with the conical port; in another embodiment the conductors 19 terminate in spring-loaded contacts which abut the ammunition tube contacts SA upon insertion of the ammunition tube 4 into the ammunition tube receiver.

Figure 6:
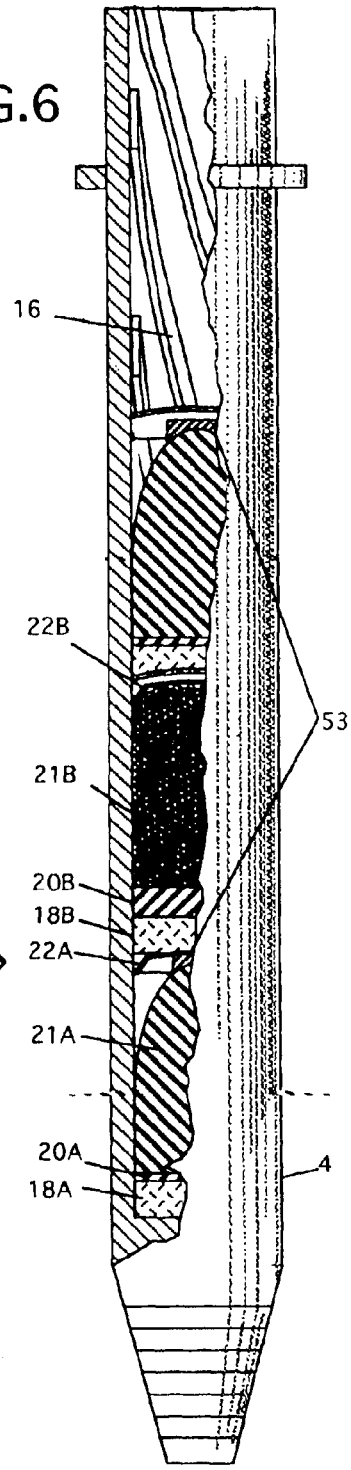
FIG. 6 shows a side-elevational view of a three-chambered ammunition tube employed in the weapon of FIGS. 2 and 3 and partly broken away to expose a typical ammunition or firing load.

Referring now to FIG. 6, the ammunition tube and exemplar ammunition loads are illustrated in partial cross section. For exposition, three different types of ammunition load are shown loaded sequentially. In the case of the solid missile 21A, wadding 20A seals the propellant 18A. A detonation plate 22A closes the ammunition load at the muzzle end. This detonation plate is key to the successful operation of the weapon: it serves to limit the rearward shock transferred to propellant 18A when the preceding propellant 18B is ignited. As shown, the detonation plate 22A is concave toward missile 21A, and at installation provides a seal across the bore of the ammunition tube. Upon ignition of propellant 183 it is forced rearwards, and the expanding conical periphery is forced into the diameter of the bore, and thus axially immobile, and thus provides a rear surface to the firing chamber of the forward ammunition load. A compressible or crushable plug 53 serves at assembly to transmit axial forces to ram the sequential ammunition loads through the muzzle. Upon discharge of the preceding propellant, and the consequential axial flexure of the detonation plate 22A, the compressible plug permits a small axial flexure of the detonation plate to occur without transfer of the shock to the next missile 21A.

Considering now the different ammunition load shown subnumbered "B", wherein a quantity of small shot constitutes the missile. This "shotgun" ammunition load similarly comprises propellant 18B, wadding 20B, and missile shot 21B, and is closed at the front by detonation plate 22B. In the case of the relatively loose shot of this example, a compressible plug is not needed to allow the small flexure of the detonation plate when the prior ammunition load is fired.

In a second embodiment of the ammunition load, the compressible plug 53 may replace the wadding 20A, and the conical seal of the detonation plate may be made integral with the side wall of the missile 21A. In this second embodiment, the missile would move slightly rearward on discharge of the preceding ammunition load, and thereby would seal its own firing chamber by expansion and pressure of the conical skirt of the detonation plate against the inner surface of the ammunition tube.

Thus according to this invention a weapon system has no moving parts other than the missiles and has the advantages of low cost in manufacture, light weight, high reliability and great ruggedness in the field. It utilizes a barrel only for one set of ammunition loads (or a few sets, if reloaded) and has the advantages of low cost in manufacture and enables the use of thin barrels of lightweight materials. Where a conventional automatic firearm must withstand the shock, pressure and bore erosion of firing thousands of rounds, the limited firing through the bore of the present invention allows for the use of unconventional materials and manufacturing methods. Such unconventional manufacturing methods may include the use of lightweight metals and the use of circumferential fiber strengthening, among others. Thus this limited-life barrel can potentially decrease the weight of the loaded weapon by several pounds.

A weapon made according to the present invention has the further advantage of rapid reloading in the field by insertion of a new ammunition tube. It has the advantage of extreme rate of fire, in excess of 10,000 rounds per minute if desired, since the successive missiles are launched by electronic rather than mechanical cycling. A second round may be fired immediately after the first, traveling close behind it while passing through the barrel, and thus maintaining a high compression of the propellant gases; this has the advantage of greatly increasing the velocity of the first missile, e.g., for armor piercing or greater range. Finally it has the great advantage that the instant of fire can be controlled by electronic impulse from a firing circuit, enabling the practical use of a computer firing solution from a target sensor.

Target Sensor: Target Centroid

Referring now to FIG. 7, the target sensor 1 is depicted in partial cross section. A lens means 23 serves to project the image 26 of a distant target 25 on a sensing reticle 24. For illustration, a second target 27 is shown imaged 28 on the sensing reticle. The lens means might be reflective or refractive, adapted to focus a high quality, achromatized "color-corrected" image of a distant object onto the sensing reticle 24. The waveband of transmission of the lens means 23 and of the sensing reticle responsiveness is in the range of 6 to 20 microns and preferably within the range of 8 to 14 microns. The electromagnetic radiation from objects at the temperature of human targets peaks in this preferred waveband, while the radiation from cooler foliage of vehicles or buildings is significantly less in this waveband.

The reticle 24 generates a signal which varies monotonically with the temperature of the distant object field within the projected image of the reticle, which signal is transmitted to the target sensor processor. The reticle 24 is comprised of detector elements which in concert yield information about the location and properties of target radiance falling on the reticle. The detector elements may be larger or smaller than the image of the target. Preferably it is smaller: the irradiance from a target is thus divided over a multiplicity of contiguous detector elements, to facilitate enhanced location of the center of target irradiance. Detectors for infrared use may operate uncooled, or may be cooled to decrease internal noise and thus to increase the sensitivity of the detector element to a given irradiance. Preferably the reticle will operate uncooled and thus consume no power for refrigeration. Examples of uncooled arrays of detector elements include silicon for the visible and indium antimonide or InGaAs for the near infrared (3–5 micron wavelength). The thermal infrared (6–20 micron) radiation can be detected by microbolometers, such as vanadium oxide or barium strontium titanate elements, whose electrical properties change measurably in response to a varying thermal radiation load. Another method of radiation detection uses small mechanical elements which deform under temperature change, thus changing the capacitance of each element against a stationary reference electrode. Arrays of vanadium oxide or barium strontium titanate elements are commonly used in infrared cameras for fire fighting or night vision, and are preferred materials for the target detector reticle.

Referring now to FIG. 8, one embodiment of the sensing reticle is illustrated in the form of a single detector element 29. A "target present" signal is generated by the target sensor processor 11 (FIG. 2) whenever the single detector element 29 receives radiation in excess of the background radiation by an amount which is greater than a selected positive change in signal called the "threshold". This selection of "threshold" by the operator corresponds to a preference either for higher sensitivity to small or distant or cooler targets, or for fewer "false positives" where the weapon would discharge at a merely warmer but non-target spot. Typically the "threshold" is factory set or else adjusted as an input to the target sensor processor by a prior art keypad or similar control device (not shown). It is further desirable not to fire on spots in the field which are significantly more radiant than a human target (such as an automobile exhaust or fire); thus, it is desirable to set an upper limit on positive difference in signal from the average background radiation. This may be preset in software or else selected by the operator, based on his judgement from field simulations and testing. That is to say: the radiation of a man target filling a detector element gives a certain signal corresponding to body temperature. Less signal than that might mean the element is partially filled; more signal than that means a brighter (hotter) and hence non-animal radiator is in the field.

In one embodiment of the target sensor processor the background radiation is continually measured by a separate element or elements 30 added to the reticle, which is used for measuring the radiation from a spot or spots well separated from the reticle sensor area, as representative of the background radiation. Positive difference between the reticle signal above the reference detector signal is indicative of a possible target "hot spot". Negative difference is ignored in the signal analysis, as indicative of a hot spot passing before the reference detector but not the reticle.

In a preferred embodiment of the target sensor processor for a single detector element 29, the signal from the reticle is electronically averaged over a time period of the order of a second as the image sensor is angularly moved or swept across the background, to generate a normative background signal level.

Using a single detector element of FIG. 8, the reticle must be mechanically adjusted relative to the lens, to place the detector element on the projected point of strike. This is commonly referred to as "sighting in" the weapon system. Typically this will be implemented by moving the reticle vertically and horizontally to correct for range and "windage" respectively, which includes the specific parameters of mechanical mounting and the weapon itself. Alternately the entire target sensor is similarly moved in a prior art adjustable cradle ("scope mount"). A third dimension of adjustment (focus) is desirable only for cases where close, small targets are expected. Preferably the optical system is factory adjusted or focused to the "hyperfocal" range, at which setting the targets will be usably in focus over the useful range of the weapon.

We note that this single element has limited angular resolution, or pointing precision: no data indicates which portion of the reticle element is illuminated. A sharply focused image of a distant, suitable hot radiator could illuminate any portion of the element and yield the same electrical signal. Considering the typical example of a target sensor lens means with a focal length of 100 mm, and a typical reticle element size ("D") of 100 microns ($\mu$) square, it will be seen that the projected image of the reticle at 250 meters will be a square 25×25 centimeters, and the perceived radiation could have come from any spot in that square. This is marginally acceptable resolution for a firing solution. To maximize the effectiveness of the missile it is preferable to scan the target sensor across the field of potential fire, and thus the target sensor processor the firing signal be generated when the temporal first derivative of the signal from an indicated target is zero and second derivative is negative, as the weapon is slowly scanned across the target. This will in general put the point of impact at the radiative center of the target.

Referring now to FIG. 9, another embodiment of sensing reticle is shown as a "quad cell" detector array. One example of such a detector array is the SPS240EN from Fuji & Company, Osaka, Japan. Four detectors are contiguous in a 2×2 configuration. The sum of the normalized signals from the upper two elements, subtracted from the sum of the normalized signals from the lower two elements is a measure of the vertical position of the centroid of the irradiance on the four detectors. The sum of the normalized signals from the left two elements, subtracted from the sum of the normalized signals from the right two elements is a measure of the horizontal position of the centroid of the irradiance on the four detectors. This kind of detector array and analysis is particularly interesting for two reasons, as follows.

First, the precision of locating the centroid is limited by the ratio of signal strength to amplifier and detector noise, and from conventional applications data is typically of the order of 100 times better than the angular size of a single detector. This multiplier of precision depends on the ratio of signal to noise in the measured signal. For a noisy detector and a dim target the precision multiplier might decrease to 10; using a low-noise detector and amplifier and with a bright target, the precision multiplier might increase to 1000 or more. In general quad-cell engineering a precision multiplier of 100 times improvement in precision is a reasonable rule of thumb. Solely for purposes of exposition herein and not by way of limitation, this number is used in this teaching to illustrate the expected resolution. Accordingly we note that for the example above (focal length=100 mm, and a reticle element is 100$\mu$ square) the projected uncertainty or inaccuracy in position of the centroid of the target image is thus of the order of 0.25 cm×0.25 cm at 250 m;

Second, the method can be generalized from a 2×2 matrix to an N×M matrix of any desired size, where the weighted moment of the irradiance of each detector element is summed in orthogonal axes, to establish the position of the centroid of the irradiance in those axes. This is further described in the discussion of FIG. 10 below.

As described above for the case of the single detector element, the background radiation signal is first subtracted from the signal of each detector element to establish a measurement of the increased signal received from a target. This background radiation is established either by a long-time average (of the order of a second) of the signals, or else by the use of a reference detector element (not shown) well separated from the quad cell detector elements, to measure the radiation from the off-target field.

Referring now to FIG. 10, another embodiment of sensing reticle is shown as a cruciform array 33 of detector elements. This open array may be operated in a calculational formalism analogous to the quad cell array of FIG. 9. Here, the moments of the signals from each of the elements in the horizontal rows are added to horizontally locate the centroid of the target "blob" image, and the moments of the signals from each of the elements in the vertical rows are added to vertically locate the centroid of the target "blob". That is to say (for the example of the horizontal direction):

$$X = \frac{\sum_x xS(x)}{S_{TOT}}$$

Where $\underline{X}$ is the horizontal location of the centroid of the illumination in the X-direction; x is the location of a particular detector element and S(x) is the net signal from that element; and $S_{TOT}$ is the total net signal from all the illuminated elements in the target image. The vertical location $\underline{Y}$ of the centroid of the illumination is similarly calculated. This method is called the "method of moments" and is analogous to calculating the position of the center of gravity of an irregular mass of varying density.

This addition of detector elements in array greatly extends the field of view of the target sensor, while retaining the benefits of interpolative precision by signal contribution from a multiplicity of elements. As noted in the description of FIG. 8, the average background signal is subtracted from each elemental signal to measure the incremental illumination from a target: the "net" signal. As there also noted, the background radiation may be established by a moving time average of the detectors' total irradiation as the image sensor is scanned around, or else by a separated detector element 30 which may be taken to be unilluminated by the target.

Referring now to FIG. 11, a preferred embodiment of sensing reticle is shown as a filled regular array of detector elements. Such a detector array might be for instance pyroelectric or a microbolometer array. A preferred embodiment would use a microbolometer array because it can "stare". I.e., it does not require that the input irradiance to be amplitude modulated by a mechanical chopper. Such staring microbolometer arrays are made by Indigo Systems, Raytheon, Lockheed-Martin, and Mitsubishi. For example Raytheon has made an uncooled 15×30 element microbolometer array of modest cost which can operate at 200 frames per second. Such an array is schematically depicted in FIG. 11. Here each target irradiance "blob" falls on one or more detector elements. While the "blob" shape may be unresolved if it is illuminating but a single element, it may be partly resolved into a recognizable man-image if illuminating a sufficient number of detector elements. A variety of exemplar target "blobs" or target images is now described, together with the accuracy with which one may measure the position of the centroid of the irradiation pattern of the blob. In one example of a target blob, the signal from the most irradiated detector element 35 is adjacent a less irradiated detector element 36 and an even less irradiated element 37. According to the present invention and as described above, the accuracy by which the centroid of this target image may be located vertically is of the order of 1% of an element dimension D, while the horizontal position (assumed at the vertical centerline) is actually accurate only to ±D/2 because only one row of elements is irradiated.

Target blob 38 as compared with the other blobs is indicative of a target which is larger and/or nearer, and the availability of bilateral data over a multiplicity of detector elements permits the centroid of the target to be located to within approximately ±1% D in both horizontal and vertical directions. The small single-element blob 39 is indicative of a target which is angularly smaller than one detector; its centroid is best assumed to be at the center of the element, and thus the aiming accuracy has a tolerance of only ±D/2 in horizontal or vertical directions. The aim point 34 is electronically stored in the signal processing electronics as differences among pairs of elements as already described for a quad cell, in order to give the aim point definition the accuracy of the order of ±1% of D.

For a sensibly stationary weapon the aim point is located by conventional sighting-in firing tests, using a radiating target approximately the size of the projected image of several detector elements, through the center of which the projectile passes when the weapon system is sighted in. For a moving weapon the point of aim is preferably further offset in the direction of the weapon's motion to account for ("lead") for the change of firing direction between the firing impulse and the instant the missile leaves the end of the barrel. This additional correction in the point of aim offset angle is calculated by the target sensor processor.

In actual use the weapon is generally not stationary, but wavers and moves according to the motion of the shooter. This significantly increases the absolute accuracy of the aiming operation. As the weapon's point of aim is normally moved around more or less steadily, each of the least-detectable target blobs will sequentially cross intersections between contiguous detector elements and allow the ±1% D accuracy positional measurement whenever the irradiance is on two or more such elements. A straight-line extrapolation of this time track will yield the same predictive positional accuracy even though the target image may be smaller than a single detector element.

To illustrate a target sensor using this filled array of detectors, we might postulate a lens means having a focal length of 25 mm, and a sensing reticle as depicted in FIG. 11 having 15 elements vertically and 30 elements horizontally, with each element being 0.1 mm square. In this case each element is the image of a 1 meter square at 250 meters distance: approximately the cross section of a man target. For this example, the accuracy of locating the centroid of a target image spread across a plurality of elements (and similarly the point of missile impact) would be of the order of ±1 centimeter at 250 meters, depending on the noise level of the sensing circuitry.

Unlike other sighting devices, it is not necessary that the operator using the present invention be able to visually resolve or even to perceive the image of the target. A further advantage of the present invention is that a relatively low-resolution detector array as depicted in FIG. 11 can be used for extreme precision in weapon sighting, which detector array thus can be small and consequently low in cost and package size.

Figure 12:
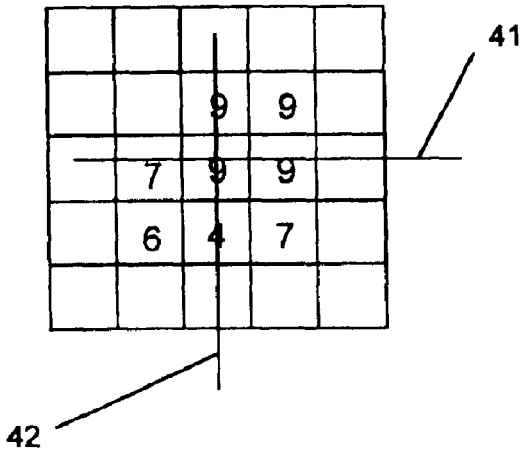
FIG. 12 shows a quantified target image on a matrix detector array.

Referring now to FIG. 12, a more detailed example is shown wherein a target image is spread across a plurality of elements. Here the signal strength from each element is indicated numerically in the element. If $R_1, R_2, \ldots R_n$ are the vectors from some point on the sensing reticle to the center of the nth element, and if the signals from each reticle are $S_1, S_2, \ldots S_n$ Then end point of the vector C $$C = \frac{\sum S_i R_i}{\sum Si},$$

summed over n detector elements will be the location of the centroid of the blob. This signal-weighted average vector position of the centroid of the target image will be the intersection of the indicated horizontal 42 and vertical 41 weighted averages of the illumination.

Figure 13:
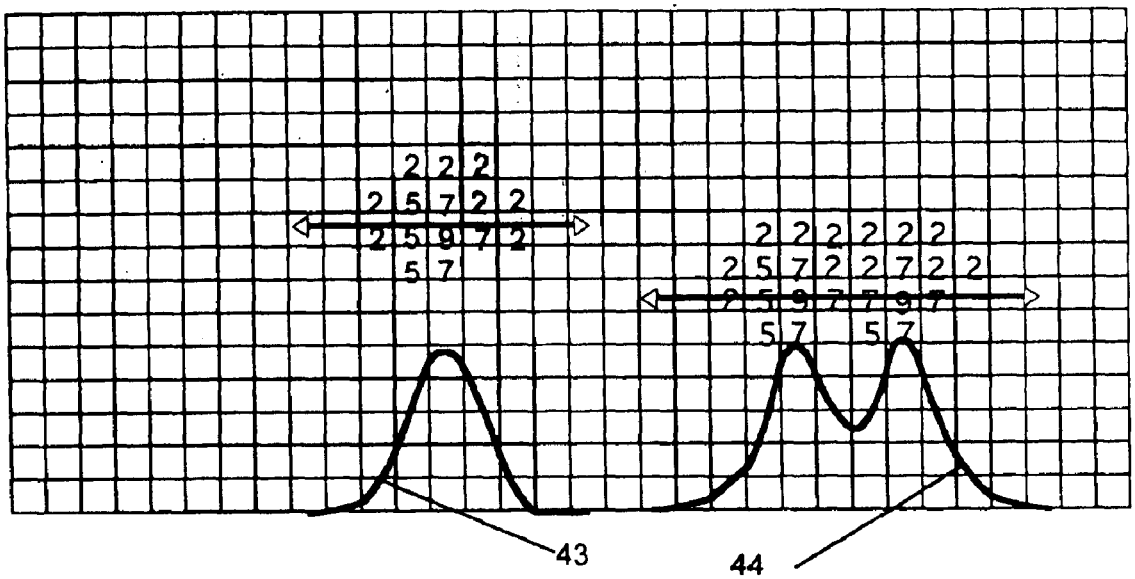
FIG. 13 shows a multiplicity of quantified target images on a matrix detector array.

Referring now to FIG. 13, various target blobs are shown and the signal strength from each element is indicated numerically in the element. The irradiance pattern on the detector is plotted at the bottom of the figure for the horizontal or X-direction, and is representative of the blob's signal strength. The blob on the left has horizontal irradiance curve 43, and is "well behaved", having but a single peak. The blob on the right is more complex, having two peaks in curve 44; this is symptomatic of the presence of two adjacent but not superimposed targets. It is specifically undesirable to have the weapon of the present invention shoot exactly between two targets when they stand close to one another. In a preferred embodiment, a mathematically very simple method separates the complex blob into separate target blobs wherever the first derivative of the curve 44 is zero and the second derivative is positive; this is taken as the mid-point between each hypothesized pair of targets. By eliminating a portion of the data from the centroid calculation, the point of aim on each target will be shifted somewhat away from the direction of the other target, but the shot will still be well within the outline of the physical target.

More complex analytical approaches may be used, such as modeling the data subtracted from a first blob by separating the two blobs, based on symmetry considerations using the measured half of the first blob, but such vernier correction are not likely to measurably increase the number of target casualties. In other embodiments prior art methods for "blob analysis" exist in the literature[1,2,3] for separating complex but unresolved blobs into multiple entities, the centroid of each of which may be calculated as a separate target.

Figure 14:
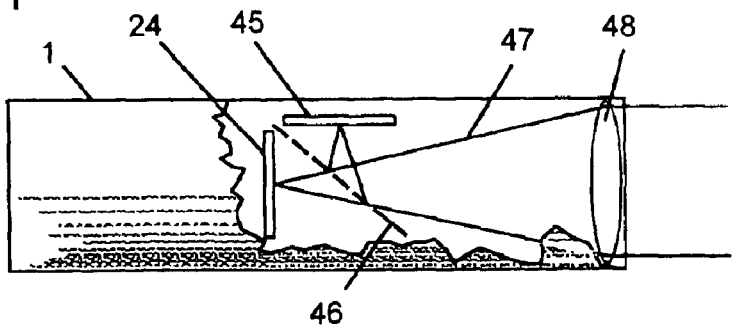
FIG. 14 shows a side-elevational view of a dual-waveband target sensor employed in the weapon of FIGS. 2 and 3 and partly broken away to expose the lens means, the beamsplitter, and the dual detectors, and showing the ray trace from an on-axis targets.

Referring now to FIG. 14, a target sensor 1 of a preferred embodiment is depicted wherein additional components enable the rejection of targets which are hotter than the expected target temperature. For instances, it is desirable not to automatically fire at an exhaust pipe or a tungsten lamp. A broadband lens means 48 is used which is achromatized for both near infrared (3–5$\mu$) and for long infrared (8–14$\mu$) wave length imaging. The lens means 48 focuses the image of a distant target on a first sensing reticle 24 as previously described. The focused beam 47 from the distant target is additionally focused on a second sensing reticle 45 via a beamsplitter means 46 which separates the 3–5$\mu$ and the 8–14$\mu$ wavebands (e.g., passing the longer wavelengths and reflecting the shorter wavelengths). The two reticles are conjugate; that is to say, at the target the image of any detector of the first sensing reticle is superimposed and congruent to the image of the corresponding element of the second sensing reticle.

In operation, the signals from the corresponding elements are compared to eliminate further signal processing of elements which are exposed to radiators of temperatures higher than that of the expected target. In one algorithmic approach, data from the element $N_I$(long waveband) is dropped from further consideration if there is a signal above a selected threshold from the corresponding element $M_I$ (short waveband). In a preferred algorithmic approach, data from the element N (long waveband) is dropped from further consideration if the signal the corresponding element $M_I$ (short waveband) is greater than a selected threshold fraction of the $N_I$ signal. In effect, such 2-color analysis renders the target sensor "blind" to targets which are hotter than human temperature.

The same dual measurement of each target point to eliminate too-hot targets could be accomplished in another embodiment using a single sensing reticle 24 with an expanded waveband of response, eliminating the beamsplitter means 46 by using alternate optical filtration for long and short waveband sensing, respectively. This might be accomplished with an oscillating optical filter or a rotating optical filter wheel. The time-sequential ratio between the signals for a given detector element $I_n$ would be a measure of the temperature of the target. This has the advantage of lower manufacturing cost, with disadvantages of higher mechanical complexity and half the integration time for the detector for each wave band.

Target Sensor: Motion Measurement and Compensation

It is preferable that compensation in the firing sequence be made for motion of the target, and for motion of the weapon, and for "bullet drop" with increasing range.

Average motion of each blob is computed using, e.g., the technique of block-based MPEG video compression. Both the angular velocity of the average background (from weapon motion) and angular target motion relative to the average background are readily calculated, and the moment of intersection of the angular motion of the target centroid with the aim point is performed by straight-line prediction. Straight-line (linear) prediction suffices due to the very short lag times relative to the limited human potential for acceleration.

The point-of-aim offset angle has two components: bullet drop and weapon motion. A range (elevation) correction can be set in for "bullet drop" if needed by very long range. We note that within ±1.5 inches of allowable vertical error no range correction is needed for an M16 military rifle with usual ball ammunition, out to 250 meters' range: the bullet rises 1.5" above the boresight at approximately 150 meters and drops to 1.5" below the boresight by 250 meters. At greater ranges the elevation correction may be made manually or be made automatically from an electronic range measurement, such as an optical laser rangefinder. Such an automatic correction for bullet drop is a vertical angle from the bore axis, related to the range R and missile velocity V as follows:

$$\Delta_l = k_1 \frac{R}{V}$$

where $k_1$ is a constant of proportionality related to the weapon and missile design.

In the general case the weapon will be moving. In fact, one of the likely modes of use of the invention will be to scan the weapon across the background, letting it fire whenever it detects a target in the compensated point of aim. In this preferred embodiment, the measured fixed time between "fire" signal from the target sensor processor and the bullet's leaving the barrel corresponds to the weapon-motion error angle -_ as a correction to the aim point: i.e., the motion-related angular offset of point of strike from instantaneous point of aim when the firing signal is initiated. The instantaneous angular velocity of the weapon is proportional to the measured velocity of the background across the image sensor, measured as already described. The electronic point of aim must be offset by an amount corresponding to that delay.

Simply enough the required weapon-motion lead angle $A_2$ is $$\Delta_2 = k_2 \beta t$$

where β=angular velocity of the background across the sensing reticle t=firearm delay time: the measured fixed time between the initiation of the firing signal and the bullet's leaving the barrel, and k=a factory constant of proportionality, including fixed optical and mechanical factors The total electronic offset angle of the point of aim is the vector sum $\Delta_1+\Delta_2$.

Additionally, correction for target motion is desirable: bullet flight for an M16 military rifle takes approximately 0.5 second at 250 m. In that time a sprinting man can move 2 to 3 meters. Extrapolating the target motion in an approximately straight line will allow the firing algorithm to provide "lead time" for target motion, effectively offsetting the electronic point of aim by a target offset angle vector $\Delta_3$ where $$\Delta_3 = k_3 \frac{\Omega}{V} R$$

wherein Ω is the measured angular velocity of the target relative to the background motion on the sensing reticle, V is the missile velocity, R is the range, and $k_3$ is a constant of proportionality generally measured at manufacture. R is set into the target sensor processor manually by the operator or automatically by means of a prior-art electronic optical rangefinder.

If we imagine the point of aim illustrated on a high resolution video image of the far field as a vector offset from the weapon bore axis, and the projected target position at the moment of missile arrival as a vector offset from the current target position, then the correct condition for a "fire" signal from the target sensor unit is that the heads of the vectors are superimposed: at that instant, a fired missile will arrive on the projected position of the target—based on straight-line extrapolations.

Figure 15:
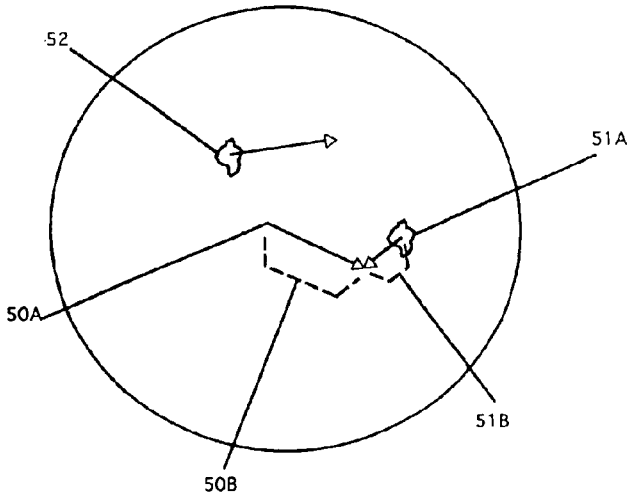
FIG. 15 shows the vector directions of the weapon and target motion in the far field.

Such an imagined video image is illustrated in FIG. 15. Here the instantaneous point of aim 50A of the weapon is shown along a dotted line, together with the positions of two target blobs 51A and 52. The point of aim offset angle 50B from the point of aim 50A is in this instance down (bullet drop) and to the right (weapon swinging to the right). The target offset angle 51B from target 51A is down and to the left (the trajectory of a target, e.g., moving down a hill face). The other target 52 being tracked by the target sensor processor is moving essentially horizontally right. As shown here the point-of-aim offset angle 50B terminates just where the target offset angle 51B terminates, as measured from the point of aim 50A and the target 51A position respectively. This is a firing solution for the target sensor processor, and a "target present" firing signal is sent to the fire controller. If a trigger signal is also present, the fire controller causes the missile to be launched from the moving weapon and thus to strike the moving target at its predicted position.

Target Sensor: Extended Targets

The discussion above has disclosed a method and apparatus for rejecting false hot spots, and for locating the centroid of a target within a fuzzy blob, and for correcting the point of aim for the effects of target motion and for weapon motion.

A final algorithmic calculation is "coring" the target blob. Here, firing is actuated anywhere within a central zone of the target blob, but not in the outer zone. This is particularly needed when the target is close and subtends a significant number of pixels. For example: If in the exemplar detector system already described the target is 25 meters distant, a man target in the above example would be 20 pixels tall×10 pixels wide. Clearly, hitting the centroid of this target is less important than hitting anywhere in the central zone of the target. Many algorithms might be used for defining the "casualty" zone of the image. In a preferred, simple algorithm, the central zone is bordered by a radiance contour which is a chosen ratio, e.g., halfway between the peripheral (or background) radiance and the peak central radiance. This is algorithmically conveniently located where the second derivative of the contour of the target blob is zero. Shots anywhere within such a central core of the target blob will then suffice to create a casualty.

System Operation

Figure 16:
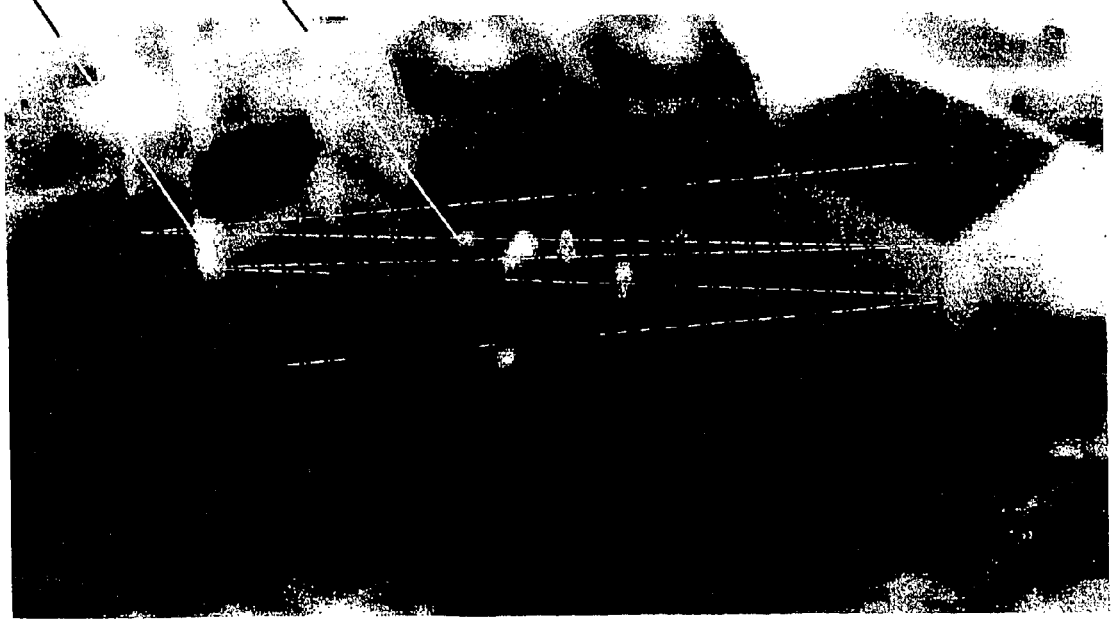
FIG. 16 shows a typical thermal image of a scene in the field, with a scan pattern of the user's point of aim.

In another embodiment of the present invention, all the signals from a sensing reticle comprised of a filled regular array of detector elements may be conducted to an image display such as a magnified flat panel display (FPD). The FPD might for examples be an organic light emitting diode or a liquid crystal display. Preferably, a miniature FPD is fitted with a magnifier eyepiece and mounted on the stock with its axis parallel to the optical axis of the target sensor, or else head- or helmet-mounted. Such an additive display for the target sensor enables the operator to visualize targets not otherwise visible, and to intentionally move the point of aim onto the selected target center. This embodiment of the weapon system provides much of the utility of prior-art day and night awareness of the distant field situation using thermal infrared viewing telescopes, but at a fraction of the current size, power and cost. In a final embodiment of the present invention servo drive motors may be added to the support means in order to aim the weapon on command of a search engine, providing a robotic weapon system which is effective against targets within the search pattern without the attendance of an operator. Such a prior art search engine has programmed patterns of searching an environment seeking targets, such as a repeating geometric pattern of scan, or by indication from thermal or motion sensors. Referring now to FIG. 16, a representation of one method for using the invention is depicted, adapted from an actual infrared telescope image of relatively low resolution. Five human targets are shown running in front of the buildings. As indicated by the dotted lines, the rifleman in the dark has pulled the trigger and blindly swung his point of aim back and forth, with no certainty of where the enemy is, except perhaps generally from sound or a light flash. In 5 to 10 seconds he covers a sizeable region of the field in 5 scans of approximately 30 meters each, at this scale. With the use of the present invention he would have fired six rounds as he traversed four of the targets six times, and would have missed only the bottom target. Using a prior art automatic weapon he would have blindly emptied a 30 rounds magazine, or approximately one bullet every 5 meters, and would be quite unlikely to have hit any one of the targets. Note that inanimate thermal infrared radiators such as the radiant windows 53 and 54, or a vehicle hood or exhaust would have caused the weapon to discharge if the target sensor lacked the means described above to discriminate against radiators which are optically hotter than a human radiator. Such weapon fire may or may not be seen as useful by the user, and preferably the temperature discrimination can be turned on or off at the user's preference.

CONCLUSION

Accordingly, the reader will see that the target-actuated weapon of this invention can be used to greatly increase the number of missiles fired with effect to hit targets, and greatly decrease the number of missiles fired to miss targets. It is capable of adjusting the instantaneous projected point of strike of the missile to compensate for weapon and target motion. Furthermore the target-actuated weapon has additional advantages among which are:

- it permits provision of a very light-weight weapon;
- it provides a weapon capable of extremely high burst rates of fire;
- it provides very rapid reloading of the weapon;
- it optionally provides a weapon having a plurality of parallel ammunition tubes;
- it provides a weapon which can be sequentially and accurately fired on many targets over a wide field without the user's aiming at, or even seeing the targets;
- it provides for a visual display of target presence on and near the point of strike.

Although the description above contains many specificities, these should not be construed as limiting the scope of the invention but as merely providing illustrations of some of the presently preferred embodiments of this invention. For instance, the invention is applicable to handguns, shouldered weapons, field guns, vehicle-mounted firearms, antipersonnel mines, and any other electrically-initiated device which has an axis of action intersecting a target object.

It will be obvious that the present invention and its signal processing methodology can readily be extended to utilize the video output signals from any prior art thermal infrared telescope fitted in the place of the image sensor already described, mounted on and controlling an electrically operated firearm or antipersonnel mine or other triggered device.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

Thus the scope of the invention should be determined by the appended claims and their legal equivalents, rather than by the examples given.

I claim:

1. A system for electronically actuating a firearm, comprising:

a target sensor unit configured to determine a target offset angle, compute a point-of-aim offset angle, and generate a target sensor signal when the target offset angle and the point-of-aim offset angle are substantially coterminous, having the same end point, wherein the target sensor unit further comprises a target sensor configured with a first detector to detect electromagnetic radiation having wavelengths within 8 to 14 microns and to generate detector signals, and a target sensor processor coupled to the target sensor for analyzing the detector signals to generate the target sensor signal; and a firing unit electrically coupled to the target sensor unit, the firing unit configured to electronically ignite one or more axially loaded ammunition loads upon receiving the target sensor signal and a trigger signal.

2. The system of claim 1, wherein the target sensor unit further comprises: a second detector configured to detect electromagnetic radiation having wavelengths within 3 to 5 microns and having signals which are spatially correlated with the signals of the first detector having wavelengths within 8 to 14 microns, and the target sensor processor analyzes signals from the first and second detectors, which first and second detector signals in ratio are indicative of target temperature.

3. The system of claim 1, wherein the target sensor is an array of microbolometer detector elements.

4. The system of claim 3, wherein the target sensor array is a quad cell detector array.

5. The system of claim 1, wherein the target sensor is an array of detector elements from among the class of barium strontium titanate, vandium oxide, amorphous silicon or bimetal compositions.

6. The system of claim 5, wherein a position of a target is determined by a sum of moments of the signals from ents illuminated by a target image.

7. A system for electronically actuating a firearm, comprising:

a target sensor unit configured to determine a target offset angle, compute a point-of-aim offset angle, and generate a target sensor signal when the target offset angle and the point-of-aim offset angle are substantially coterminous, having the same end point; and a firing unit electrically coupled to the target sensor unit, the firing unit configured to electronically ignite one or more axially loaded ammunition loads upon receiving the target sensor signal and a trigger signal, the firing unit further comprising an ammunition tube configured to store the one or more axially loaded ammunition loads;

an ammunition tube receiver configured to insertably accept the ammunition tube;

a fire controller for generating a firing signal upon processing the target sensor signal and the trigger signal; and a sequence controller for sequentially discharging the one or more axially loaded ammunition loads upon receiving the firing signal.

8. The system of claim 7, wherein the ammunition tube has a conically shaped receiver end electrically coupled to the ammunition tube receiver, and a distal muzzle end for guiding the discharged one or more axially loaded ammunition loads.

9. The system of claim 7, wherein an outer wall thickness of the ammunition tube is 0.03 to 0.25 inches.

10. The system of claim 7, further comprising:

a plurality of receiver tube electrical contacts;

a receiver firing circuit configured to electrically couple the sequence controller and the plurality of receiver tube contacts;

a plurality of ammunition tube contacts electrically coupled to the plurality of receiver tube contacts; and an ammunition tube internal firing circuit for electrically coupling each of the plurality of ammunition tube contacts with a corresponding ammunition load of the one or more axially loaded ammunition loads.

11. The system of claim 7, further comprising:

a plurality of ammunition tubes;

the ammunition tube receiver configured to insertably accept the plurality of ammunition tubes; and the sequence controller for sequentially discharging the one or more axially loaded ammunition loads in the plurality of ammunition tubes upon receiving the firing signal.

12. A method for actuating a firearm having axially loaded ammunition loads, comprising the steps of:

identifying a target based upon target radiation patterns having wavelengths within 8 to 20 microns;

determining a point-of-aim offset angle based upon a bullet drop, a firearm delay time and the motion of the firearm;

determining a target offset angle based on motion of the target, a flight velocity of the axially loaded ammunition loads, and a target range; and electronically igniting the axially loaded ammunition loads when end points of the point-of-aim offset angle and the target offset angle are substantially coincident.

13. The method of claim 9, further comprising the step of computing a centroid of the target radiation patterns, the centroid corresponding to a target position.

14. The method of claim 9, further comprising the step of defining a central zone of the target radiation patterns, the central zone corresponding to a target position.

15. The method of claim 14, wherein the central zone is bordered by a radiance contour, the radiance contour defined at points within the target radiation patterns where a second derivative of radiance of the target radiation patterns is zero along a chord of the target radiation patterns.

* * * * *